US010779645B2

(12) United States Patent
Siaperas

(10) Patent No.: US 10,779,645 B2
(45) Date of Patent: Sep. 22, 2020

(54) CABINET AND EXERCISE APPARATUS

(71) Applicant: Matthew Siaperas, Pocatello, ID (US)

(72) Inventor: Matthew Siaperas, Pocatello, ID (US)

( * ) Notice: Subject to any disclaimer, the term of this patent is extended or adjusted under 35 U.S.C. 154(b) by 8 days.

(21) Appl. No.: 16/211,770

(22) Filed: Dec. 6, 2018

(65) Prior Publication Data

US 2019/0166993 A1 Jun. 6, 2019

Related U.S. Application Data

(60) Provisional application No. 62/595,502, filed on Dec. 6, 2017.

(51) Int. Cl.

| | |
|---|---|
| ***A47B 81/00*** | (2006.01) |
| ***A63B 21/00*** | (2006.01) |
| ***A63B 21/055*** | (2006.01) |
| ***A47B 97/00*** | (2006.01) |

(52) U.S. Cl.

CPC ..... *A47B 81/00* (2013.01); *A63B 21/0552* (2013.01); *A63B 21/4033* (2015.10); *A47B 2097/008* (2013.01); *A63B 2210/00* (2013.01); *A63B 2210/06* (2013.01)

(58) Field of Classification Search

CPC ..... A47B 81/00; A47B 2097/008; A63B 2210/06; A63B 21/4033; A63B 21/0552; A63B 2210/00–2210/58

See application file for complete search history.

(56) References Cited

U.S. PATENT DOCUMENTS 332,989 A * 12/1885 Benedict ..... A63B 21/0628 482/102
382,440 A * 5/1888 Sanchez ..... A63B 21/0628 482/102
1,365,460 A * 1/1921 Cooper ..... A61H 33/06 4/532
1,646,818 A * 10/1927 Holland ..... A63B 17/00 482/102
1,776,204 A * 9/1930 Tascarella ..... A61G 13/105 5/613
2,219,219 A * 10/1940 Boger ..... A63B 23/00 482/130

(Continued)

FOREIGN PATENT DOCUMENTS

WO WO-8601735 A1 * 3/1986 ..... A63B 22/203

*Primary Examiner* — Nyca T Nguyen

(74) *Attorney, Agent, or Firm* — Pedersen & Company, PLLC; Ken J. Pedersen; Barbara S. Pedersen

(57) ABSTRACT

A cabinet, for storing and conveniently deploying a box-like exercise apparatus, has a small footprint, and receives and secures the exercise apparatus on the inside surface of the cabinet's front wall. The exercise apparatus may be quickly and easily deployed from its storage position upright and inside the cabinet, to its in-use position, horizontally in front of the cabinet on top of the inside wall surface, while the outside wall surface of the cabinet, in turn, rests horizontally on the floor. Overhead rods are extendable from the cabinet and securable in one or more extended positions, for use of the rods in various exercises. The cabinet may be at least temporarily secured to a wall to secure the cabinet, and also the exercise apparatus, including the overhead rods, in place during exercises. The cabinet allows a consumer to keep its fitness equipment easily accessible and ready to use.

9 Claims, 17 Drawing Sheets

(56) References Cited

U.S. PATENT DOCUMENTS 2,474,060 A * 6/1949 Mosher ..... A63B 17/00 482/39
2,632,645 A * 3/1953 Barkschat ..... A63B 21/06 482/38
3,741,538 A * 6/1973 Lewis ..... A63B 17/00 482/120
3,746,338 A * 7/1973 Proctor ..... A63B 21/063 482/101
3,874,657 A * 4/1975 Niebojewski ..... A63B 17/00 482/104
4,026,545 A * 5/1977 Schonenberger ..... A63B 17/00 482/54
4,066,257 A 1/1978 Moller
4,300,761 A * 11/1981 Howard ..... A63B 17/00 482/130
4,344,660 A * 8/1982 Molnar ..... A63B 55/60 312/249.13
4,431,181 A * 2/1984 Baswell ..... A63B 21/154 482/102
4,679,787 A * 7/1987 Guilbault ..... A47C 17/38 482/54
4,805,901 A * 2/1989 Kulick ..... A63B 22/0605 297/118
4,976,428 A * 12/1990 Ghazi ..... A63B 23/03575 482/112
5,586,962 A * 12/1996 Hallmark ..... A63B 21/04 482/123
5,718,657 A * 2/1998 Dalebout ..... A63B 22/0023 482/112
5,743,833 A 4/1998 Watterson et al.
D404,443 S * 1/1999 Doyle ..... D21/675
6,224,516 B1 * 5/2001 Disch ..... A63B 22/02 482/51
6,245,001 B1 6/2001 Siaperas
6,520,890 B2 * 2/2003 Hsu ..... A63B 22/02 482/51
6,558,301 B1 * 5/2003 Jackson ..... A63B 21/0552 482/121
6,626,801 B2 * 9/2003 Marques ..... A63B 17/00 482/23
6,634,998 B2 10/2003 Siaperas
7,575,538 B1 * 8/2009 Clark ..... A63B 21/154 482/103
D625,122 S 10/2010 Cartaya et al.
7,972,249 B1 * 7/2011 Napalan ..... A63B 21/0628 482/106
8,075,454 B2 * 12/2011 Piggins ..... A63B 21/156 482/62
8,506,459 B2 * 8/2013 Cassidy ..... A63B 21/156 482/102
9,744,400 B2 * 8/2017 Cole ..... A63B 22/0089
2001/0027151 A1 * 10/2001 Siaperas ..... A63B 21/04 482/142
2002/0091043 A1 * 7/2002 Rexach ..... A63B 21/0628 482/98
2002/0123415 A1 * 9/2002 Marques ..... A63B 17/00 482/123
2006/0142129 A1 * 6/2006 Siaperas ..... A63B 21/04 482/142
2008/0280733 A1 * 11/2008 Dickie ..... A63B 22/001 482/52
2008/0280734 A1 * 11/2008 Dickie ..... A63B 22/0023 482/54
2009/0181833 A1 * 7/2009 Cassidy ..... A63B 21/156 482/94
2010/0043142 A1 * 2/2010 Whitford ..... A47C 17/46 5/136
2016/0074698 A1 * 3/2016 Figueroa ..... A47C 17/38 5/2.1
2016/0096062 A1 * 4/2016 Moerth-Cross ..... A61G 13/105 482/101
2017/0027316 A1 * 2/2017 Zinkus ..... G09B 19/00
2017/0100622 A1 * 4/2017 Wall ..... A63B 21/0552
2017/0197109 A1 * 7/2017 Cole ..... A63B 22/0089
2020/0001155 A1 * 1/2020 Lopez ..... A63B 71/0036

* cited by examiner

100
TS
92
90
26
IS

25

30
24

31

CABINET AND EXERCISE APPARATUS

This application claims benefit of Provisional Application Ser. No. 62/595,502, filed Dec. 6, 2017, the entire disclosure of which is incorporated herein by this reference.

BACKGROUND OF THE TECHNOLOGY

Field of the Technology

This technology relates generally to cabinetry and exercise apparatus. More specifically, this disclosed technology relates to a cabinet for storing an exercise apparatus while the apparatus is not in use, and for conveniently deploying the apparatus and imparting to it additional functionality while the apparatus is in use.

Related Art

U.S. Pat. No. 6,245,001, U.S. Published application 2001/0027151, and U.S. Pat. No. 6,634,998, all to Matt Siaperas, the inventor of the subject technology, disclose generally self-contained exercise apparatus having a box-like main body. The top surface of the main body has a transverse hinge near its middle so the top surface may be lifted and opened up to provide access to the interior of the main body for storage, for example, of exercise elements including stretch bands, cords and connectors and handles, etc. for exercise. Also, different sections of the opened-up top surface of the main body may be adjusted and secured at upwardly-extending angles to provide, for example, a seat 33 and seat back 34 for use during exercise. These Siaperas apparatus are typically portable, and the box-like main body may be fitted on its exterior with a handle for carrying, or with wheels and a handle for rolling/pulling as in modern luggage.

It is desired to provide a cabinet for conveniently storing the above-described or similar exercise apparatus in a small area. Also, it is desired to provide a cabinet for conveniently deploying the exercise apparatus from a stored state to an in-use state, and for conveniently returning the exercise apparatus to the stored state. An object of this technology is to provide such a desired cabinet.

U.S. Pat. No. 332,989 (Benedict) discloses an upright exercise apparatus cabinet with a top and a bottom section. U.S. Pat. No. 2,219,219 (Boger) discloses a portable exercise apparatus cabinet that opens to provide an elevated seat for exercising. U.S. Pat. No. 4,431,181 (Baswell) discloses an exercise apparatus storage cabinet that opens to provide a fold-out A-frame support structure for exercise. U.S. Pat. No. 7,575,538 (Clark) discloses a fold-up exercise apparatus with pivotal arms and guide assembly that translates vertically within a frame assembly. U.S. Pat. No. 9,744,400 (Cole) discloses a cabinet with a fold-down front panel of an exercise module and an adjacent storage module.

Still, there is a need for a cabinet for storing an exercise apparatus, which cabinet takes up very little space, enables quick and easy deployment of the exercise apparatus, and, in addition, cooperates with and imparts more functionality for the exercise apparatus in use, compared to the functionality of the exercise apparatus without the cabinet. This technology addresses that need.

SUMMARY

The invention comprises a preferably upright cabinet for storing and conveniently deploying a preferably box-like exercise apparatus. Preferably, the cabinet is generally rectangular, and taller than it is wide or deep. The cabinet receives and secures a box-like exercise apparatus on the inside surface of the cabinet's front wall. This way, with a hinge provided at the bottom of the cabinet's front wall, for example, the exercise apparatus may be quickly and easily deployed from its storage position upright and inside the cabinet, to its in-use position that is horizontal or generally horizontal and in front of the cabinet on top of the front wall inside surface, while the front wall outside surface of the cabinet, or footings or handles extending from it, in turn, rest horizontally or generally horizontally on the floor. Also, preferably, the cabinet may be at least temporarily secured to a wall. This way, when deployed and in use, the box-like apparatus is stationary and stable on the cabinet's front wall inside surface that has been moved to be horizontal or generally horizontal on the floor in front of the cabinet.

The exercise cabinet can be made out of a wide variety of materials, for example, plastic, metal, or wood. Preferably, the exercise cabinet takes up less than approximately 6 square feet of floor space (the "in-use footprint") when in use, and less than 2 square feet of floor space (the "closed or storage footprint") when not in use. Certain embodiments may be approximately 5 feet (60 inches) high, by 20 inches wide, by 10 inches deep.

The cabinet preferably has two compartments: the larger bottom compartment is enclosed and houses a box-like exercise apparatus or other similar fitness machine. For example, box-like exercise apparatus such as the fitness machines described and/or patented in Siaperas U.S. Pat. No. 6,245,001, U.S. Published Application 2001/0027151, and U.S. Pat. No. 6,634,998, or similar fitness machines, may be installed temporarily or permanently for use in and with the disclosed cabinet. In addition to housing the fitness machine, the larger bottom compartment also serves as an organized storage space for disconnectable components of the fitness machine, also known as exercise elements such as, for example, stretch bands, cords and connectors and handles that can be hung on the interior walls of the cabinet by means of various conventional fasteners, for example.

Preferably, a smaller top compartment in the cabinet may be an opening or shelf at the top thereof that, for example, may house information on the use of the fitness machine including various exercises that the user can perform using the cabinet and the fitness machine together.

An especially preferred feature of the disclosed cabinet and exercise apparatus system comprises at least one overhead rod or bar support that is extendable from near the top of the cabinet, and temporarily securable in one or more extended positions above the top wall of the cabinet, for use of the rod in various exercises. As portrayed in the drawings, preferably there are two extendable overhead rod assemblies. Preferably made of metal for strength, the rods may be rectangular, but, in certain other embodiments, may instead be round or flat in shape, for example. Each overhead rod assembly is anchored at or near its lower end inside the cabinet, for example, by means of a surrounding sleeve anchored at one or more locations inside the cabinet and slidably holding the rod. The extendable/slidable rod moves by telescoping out from the sleeve, or by other extension means, to above the cabinet. One example of other extension means is for the overhead rod to be of a fixed length, and connected to the cabinet with, for example, a pivotable connection. This way, the rod may rest alongside a wall of the cabinet, for example, and be pivotally connected to the cabinet at or near the top thereof, and rotate up to extend up and out from the cabinet. The extent of the rod's rotation in this case may be adjustably selectable, being fixed, for example, at various degrees of rotation and therefore different elevations, by a locking ratchet or compression friction fit mechanism, for example.

An overhead rod preferably extends from each of the right and left sides of the cabinet and preferably is sized and adjustably secured/latched to place the outermost rod end at a location selected by the user in the range of 1-4 feet, or more typically a range of 1-3 feet, above the top wall of the cabinet. Thus, the preferred rods may be secured/latched to extend from near the top of the cabinet to reach different extended position points, as chosen by the user, to place the rod ends at various heights above the floor depending on the user's height. Elastic or fixed (non-elastic) bands or cords that come with the fitness machine may be attached to the rods by hooking them, with a carabiner-type component that may be fixed to an attachment point on the outermost ends of the rods, for example, allowing the user to perform a variety of overhead exercises with the fitness machine. It may be noted that the at least temporary securement of the cabinet to the wall, mentioned above, helps keep the cabinet and the overhead rods stationary and stable during exercise, which exercise may apply substantial force to the overhead rods and hence substantial force to the cabinet.

Thus, the preferred overhead rods may be telescoped, slid, or otherwise extended up and secured in the selected in-use position for exercises that apply force on the rod ends, and the rods then retracted down into the interior of the cabinet, for example, for storage when not needed. When the rods are retracted and the cabinet is closed, the lowered rods are hidden inside the cabinet and the cabinet is returned to its unique appearance resembling a piece of furniture and hiding or disguising the fact that it's part of a fitness machine.

The cabinet may be made to order, to be integrated with the look of the surroundings in which it will be placed, so that it blends in to appear like a piece of furniture. This will allow the user to keep its fitness equipment easily accessible and ready to use rather than hidden under a bed or it in a closet to store it. "Out of sight, out of mind" may cause the user to be more likely to abandon its workout. However, the cabinet of this disclosed technology will keep the exercise apparatus system in view but disguised, and the exercise apparatus will be quickly and conveniently ready to use, so probably it will be used more often.

Another unique feature of this disclosed technology is that it is adaptable for use either with a fitness machine permanently installed in the cabinet, or with a detachable and removable fitness machine. Portable fitness machines such as the Siaperas machines, mentioned in the Related Art section above, and portrayed in the Figures, are preferred as they may be detached from the cabinet and transported to another distant location. For example, as shown in the Figures, the Siaperas machines may be temporarily retained on top of the inside of the front door/deck of the cabinet when in use, by multiple retainers/stops, but also may be slid out and away from the retainers/stops and off of the door/deck. This way, users of Siaperas machines may bring their machines to a club, gym, hotel or other establishment providing the cabinet, to utilize the full capability of the Siaperas machines, plus the additional overhead exercise capability offered by the overhead rods, and the attractive and easy-access storage option, provided by the combination of the cabinet of this disclosed technology and the Siaperas machines.

Thus, certain fitness machine embodiments may be used both with the cabinet and separate from the cabinet. However, use of the fitness machine with the cabinet has been found to be very effective, due to this combination conveniently allowing many different exercises, including additional overhead exercises due to the extendable overhead rods in the cabinet and their associated overhead-extending exercise cords or other exercise elements. An additional feature of using the fitness machine in combination with the cabinet is that the preferred way that the fitness machine sits on top of the deployed door of the cabinet serves to raise the top of the machine from 3-24 inches, and more preferable 6-18 inches up off the floor, making it easier to use the machine for a variety of exercises, including, for example, aerobic step-up exercises. In summary, the preferred cabinet and exercise apparatus system, comprising a fitness machine in combination with the subject disclosed cabinet, houses roughly "a full gym in a cabinet", allowing the user to keep its fitness equipment handy and disguised in plain view so the user is more apt to stay with its fitness program.

BRIEF DESCRIPTION OF THE DRAWINGS

FIG. 5 is a detail view of the circled region of the securement system in FIG. 4.

FIG. 7 is a detail view of the securement system as it is separated in FIG. 6.

FIG. 25 is a detail view of a region circled in FIG. 24, showing connection of exercise straps to the main body of the fitness machine.

FIG. 26 is a detail view of a second region circled in FIG. 24, showing connection of the exercise straps to the combar.

FIG. 33 shows the trim exploded away from the closed cabinet, to show a steel reinforcing L-bracket that helps secure the two overhead rods, to keep the rods from breaking through the upper region of the front or side wall of the cabinet, under heavy stress that may occur during overhead exercises.

DETAILED DESCRIPTION OF CERTAIN EMBODIMENTS

Referring to the Figures, there is shown one, but not the only, preferred embodiment of the disclosed technology. While a user of the disclosed combined exercise apparatus and cabinet is not drawn in the figures, a viewer of the figures, after reading this disclosure, will understand use of the fitness machine in combination with the cabinet. Further information on use and features specific to the portrayed fitness machine may be obtained from, for example, U.S. Pat. No. 6,245,001, U.S. Published application 2001/0027151, and U.S. Pat. No. 6,634,998, all to Matt Siaperas, which are hereby incorporated into this document by this reference.

Figure 1:
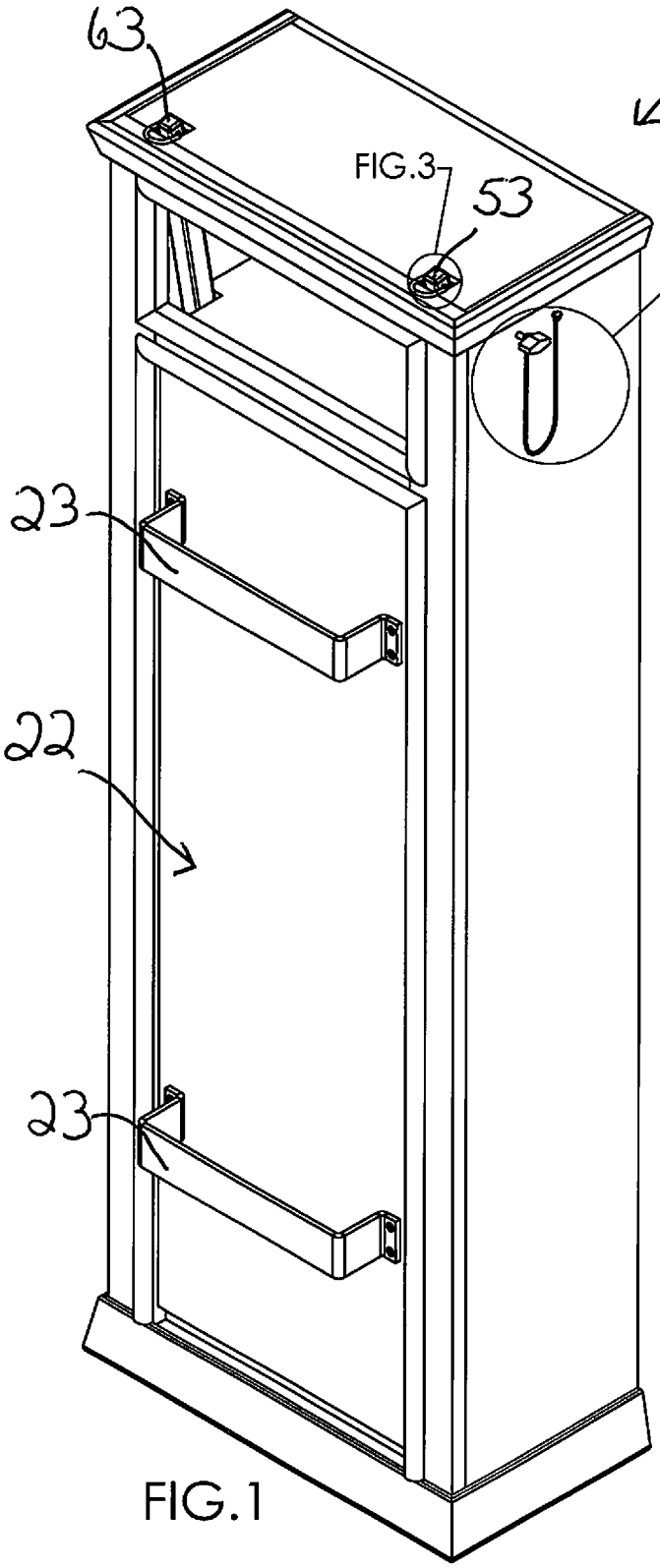
FIG. 1 is a top, right side perspective view of the front of the subject exercise apparatus cabinet 10, in the closed, or storage, position.

One of several embodiments of the technology is depicted in FIGS. 1-34, and is described as follows:

FIG. 1 is a top, right side perspective view of the front of the subject exercise apparatus cabinet 10, in the closed, or storage, position. Even with the door 22 closes in this view, one may see the small (relative to interior space IS of the cabinet, visible in FIG. 8, for example,) top space/compartment TS in the cabinet, which may be an open shelf as in this embodiment, or which may alternatively comprise its own door and/or a drawer, for example.

Figure 2:
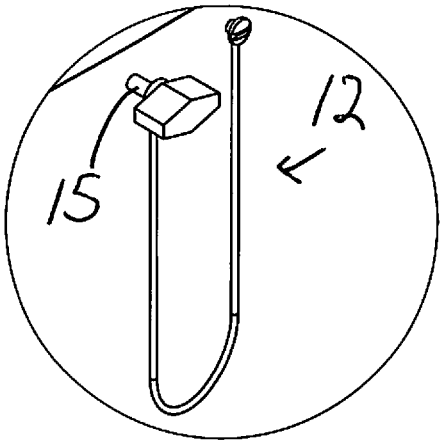
FIG. 2 is a detail view of a latch chain system, circled in FIG. 1.

FIG. 2 is a detail view of a latch chain system 12 circled in FIG. 1, for the right extendible overhead rod 52. See use of the latch chain system 12 with rod 52 depicted in FIGS. 20 and 21, which are further described below.

Figure 3:
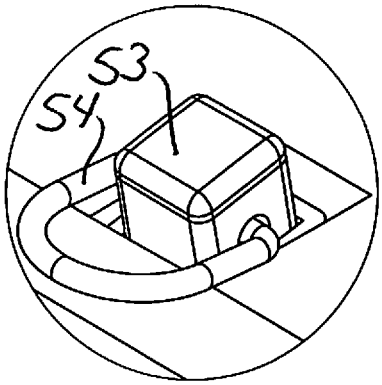
FIG. 3 is detail view of the top end (outermost end) of the right overhead rod of FIG. 1.
Figures 20, 21:
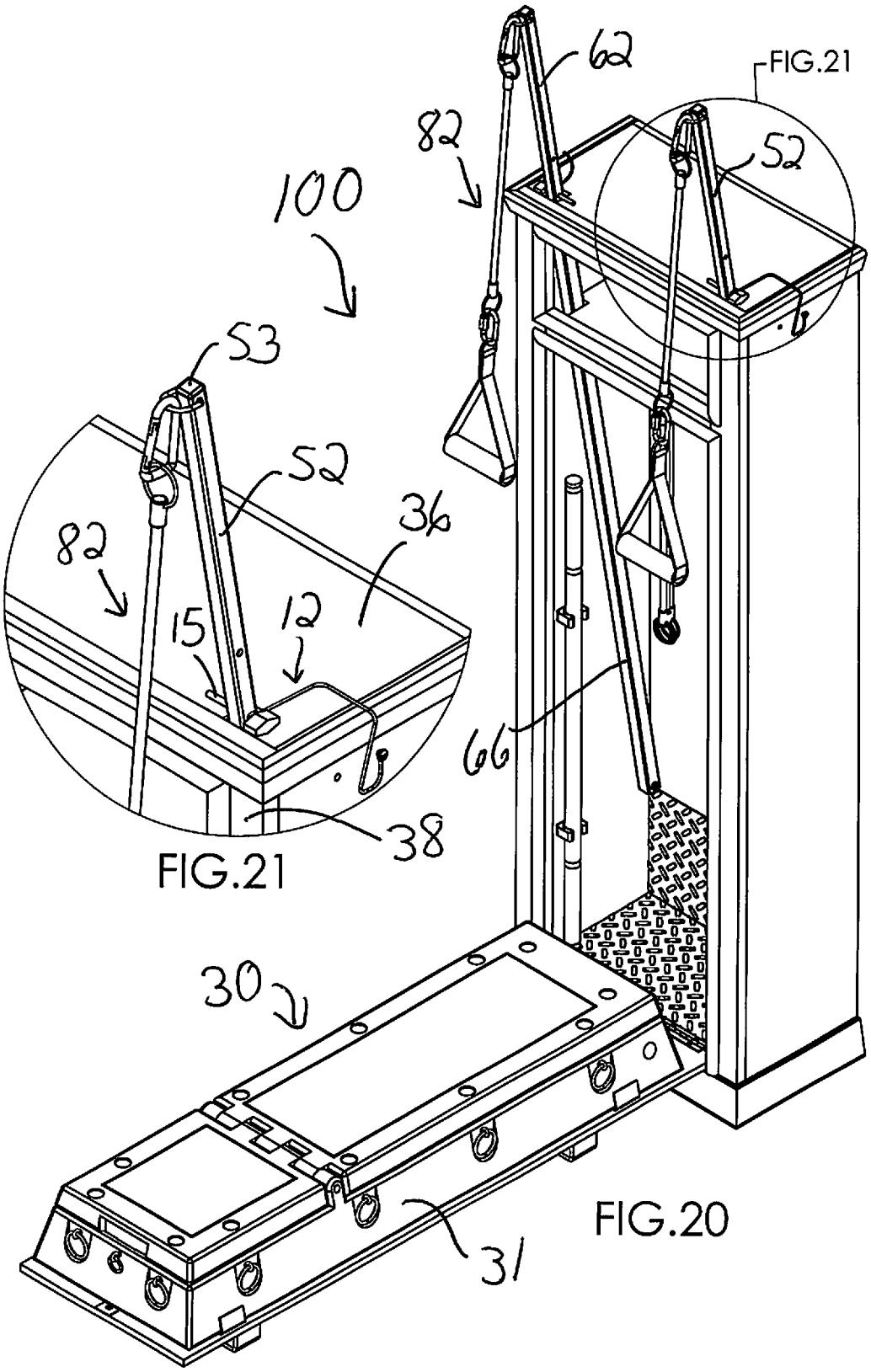
FIG. 20 is a view similar to that in FIG. 8, except that, in FIG. 20, two overhead rods or other arms extend outwardly from the top of the cabinet and are connected to exercise accessory cords/cables with handles for use in overhead exercises.
FIG. 21 is a detail of a circled region of FIG. 20, serving to enlarge for the viewer the area wherein the right rod extends up and forward from the top wall of the cabinet, and is latched there by the chain assembly, for effective exercises using the exercise accessory connected to the rod.

FIG. 3 is detail view of the top end 53 (outermost end) of the right overhead rod 52, including a D-ring 54 that holds the overhead rod 52 from falling or retracting father into the cabinet 10 and also adapted to receive an exercise cable/cord as shown in FIGS. 20 and 21.

Figure 4:
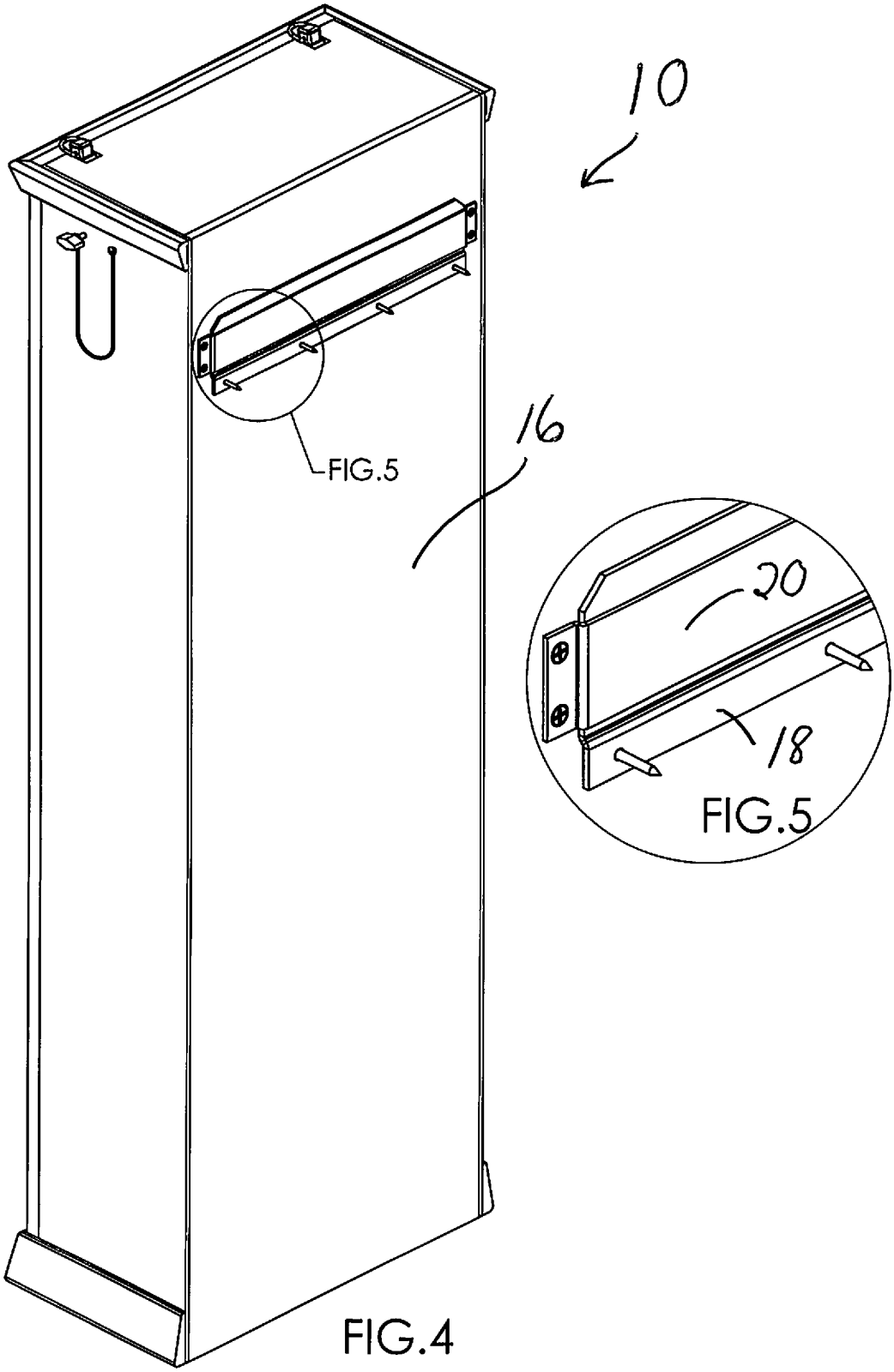
FIG. 4 is a top, back perspective view of the cabinet of FIG. 1, illustrating an embodiment of a securement system for connecting the cabinet 10 to a wall.
Figure 6:
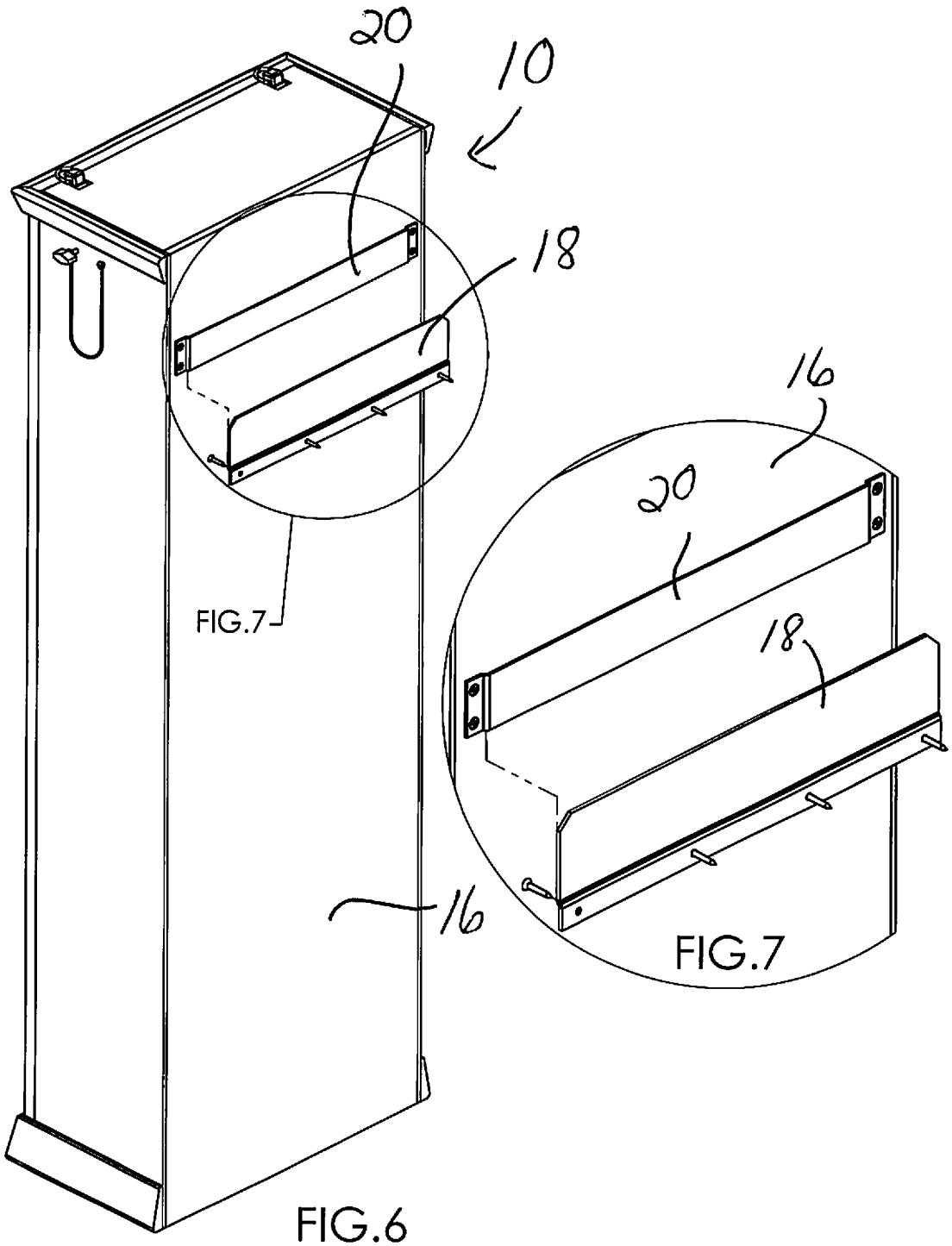
FIG. 6 is a top, back perspective view of the cabinet 10, with the two main components of the securement system of FIG. 4 separated.

FIGS. 4-7 illustrate the back 16 of the cabinet 10 of FIG. 1, and the preferred securement system for connecting the cabinet 10 to a wall. FIG. 4 is a top, left-side perspective view of the back 16 of the cabinet 10 of FIG. 1, and FIG. 5 is a detail view of the circled region in FIG. 4, wherein FIGS. 4 and 5 show the parts of the wall securement system connected together, without showing the wall to which the wall plate portion 18 is nailed or screwed for easier viewing of the bracket 20 and wall plate 18. FIG. 6 is a top, left-side perspective view of the back of the cabinet 10, and FIG. 7 is a detail view of a portion of the securement system, wherein the bracket 20, still fixed to the back of the cabinet 10, is disconnected from the wall plate 18. From these figures, one may understand that the wall plate may be nailed or screwed to a wall or studs thereof, and the bracket may be fixed to the back of the cabinet 10, and then the cabinet 10 may be lowered down against the wall to slide the bracket onto the top portion of the wall plate, to secure the bracket and hence the cabinet 10 to the wall plate and wall.

Figures 8, 9, 10:
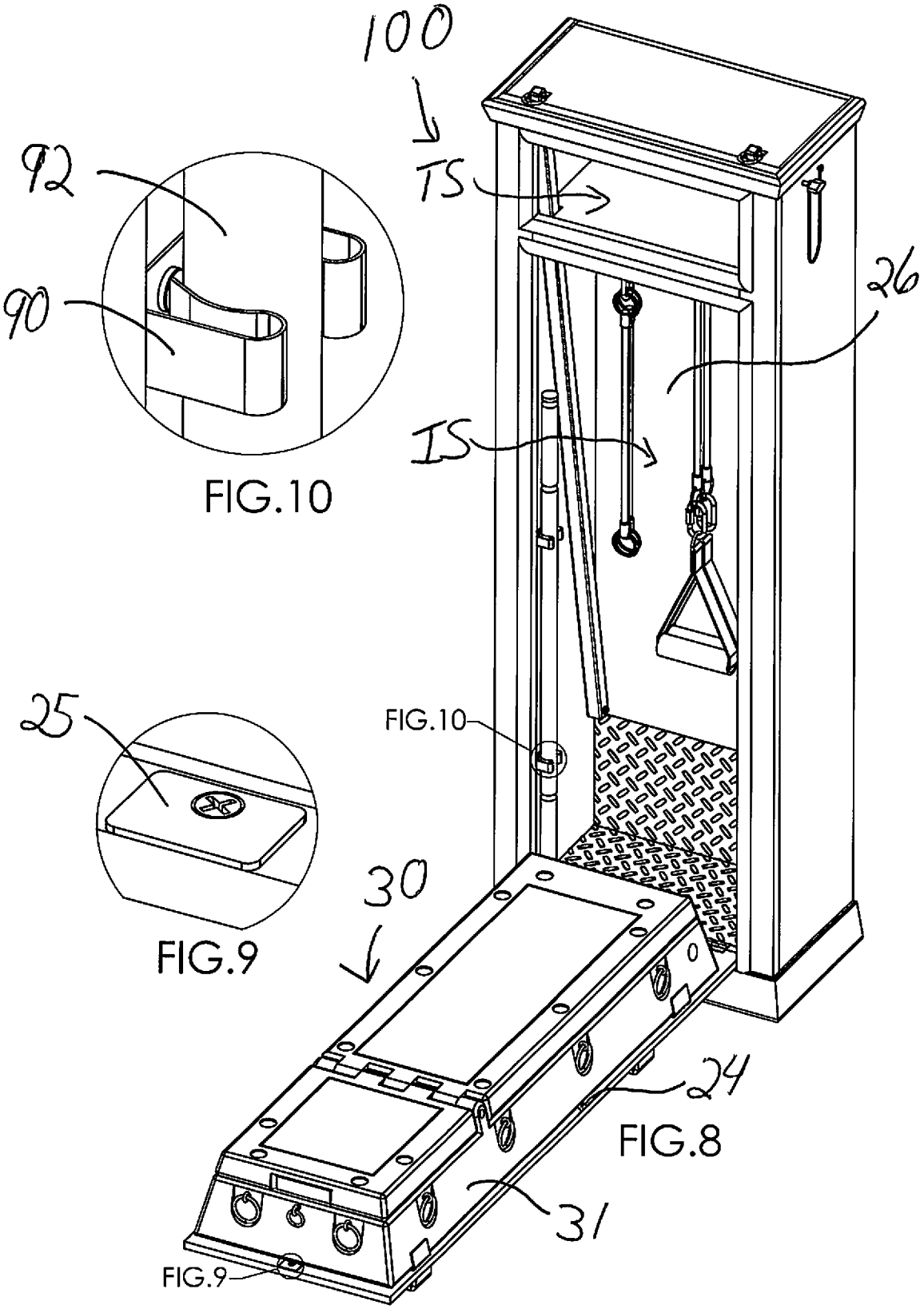
FIG. 8 is a top, right-side perspective view of the front of the exercise cabinet, with door opened and the fitness machine deployed for use.
FIG. 9 is a detail of a circled region of FIG. 8, showing a magnetic plate that is part of the door closure/latch.
FIG. 10 is a detail of a circled region of FIG. 8, showing one of the clips installed inside the cabinet interior space, for holding and storing an exercise member.

FIG. 8 is a top, right-side perspective view of the front of the subject exercise cabinet and apparatus (the "combined machine and cabinet" 100) in the open, or deployed for use, position. The door 22 of the cabinet is opened and pivoted down to be horizontal or generally horizontal, resting on its footings or handles, bringing with it the exercise apparatus or "fitness machine" 30 connected to the top surface 24 of the inner side of the door (or "the deck"). The term "generally horizontally" means from 1 to 25 degrees of horizontal. Certain embodiments, as may be understood from the figures, of the door and the fitness machine in the deployed position are in the range of 5-20 degrees, and more preferably 5-10 degrees, from horizontal.

FIG. 9 is a detail of a circled region of FIG. 8, showing a magnetic plate 25 used as a part of a magnet latch (see FIGS. 9 and 12 combined) for holding the door 22 closed when the cabinet 10 is closed-up for storage of the fitness machine 30.

FIG. 10 is a detail of a circled region of FIG. 8, showing one of the clips installed inside the cabinet interior space IS, holding an exercise member 92, such as a combar ("combination bar"), in storage until needed by a user in an exercise.

Figures 11, 12, 13:
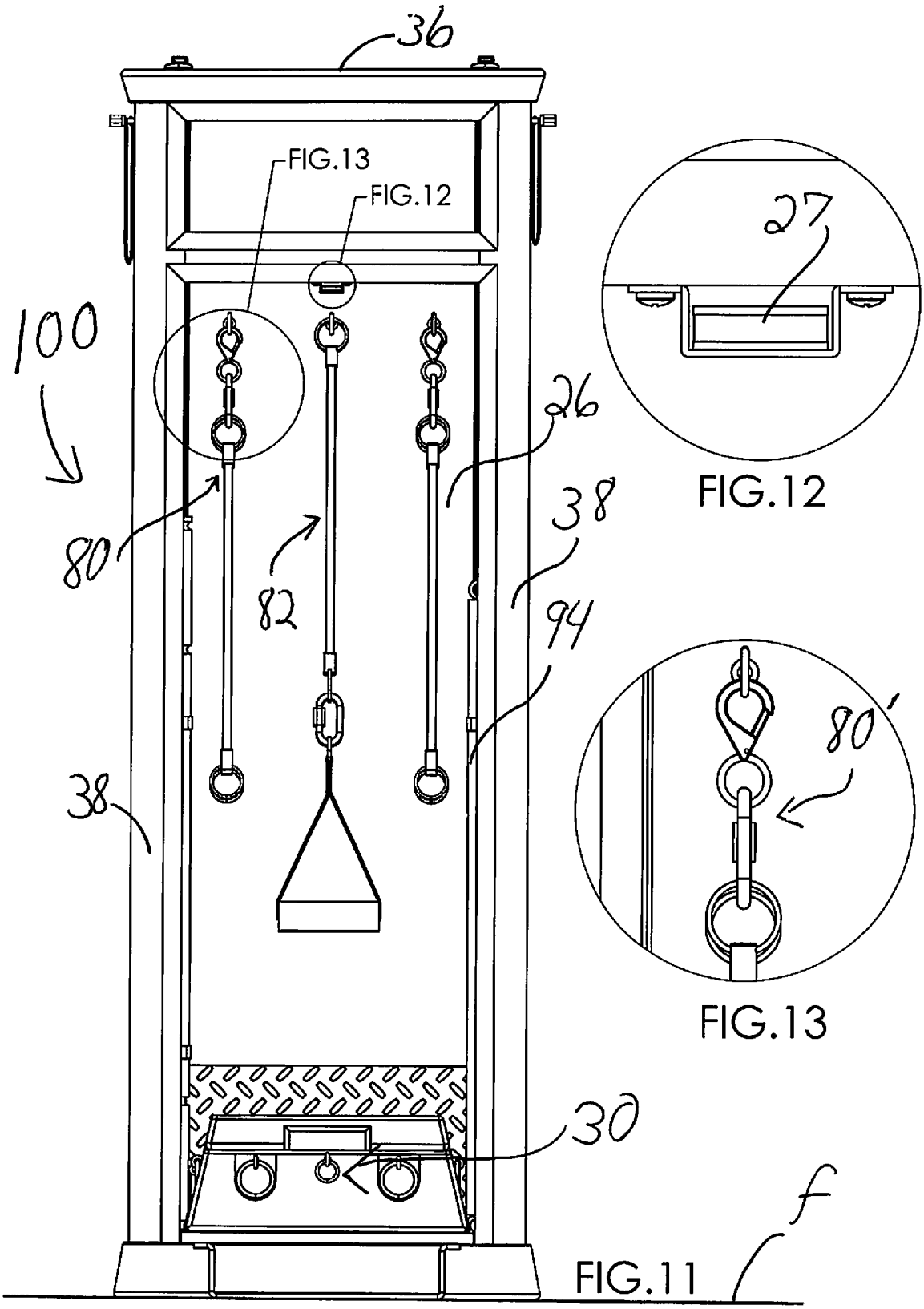
FIG. 11 is a front view of the combined fitness machine and cabinet of FIG. 8.
FIG. 12 is a detail showing a magnet piece for cooperation with the plate of FIG. 9, to form a magnetic door latch.
FIG. 13 is a detail view of one of the hook/hangers inside the cabinet and upper end of a cord/cable-style exercise accessory/element.

FIG. 11 is a front view of the combined machine and cabinet 100 of FIG. 8, showing to best advantage examples of exercise member cords and cables 80, 82 stored in the cabinet 10 on hooks and/or other fasteners fixed to the interior walls of the cabinet, including the rear interior wall 26.

FIG. 12 is a detail showing a magnet piece 27 for cooperation with the plate 25 of FIG. 9, to form a magnetic door latch.

FIG. 13 is a detail view of one of the hook/hangers, and upper end 80' of a cord/cable 80 for storing one of the cords/cables 80 until needed by a user in an exercise.

Figures 14, 15:
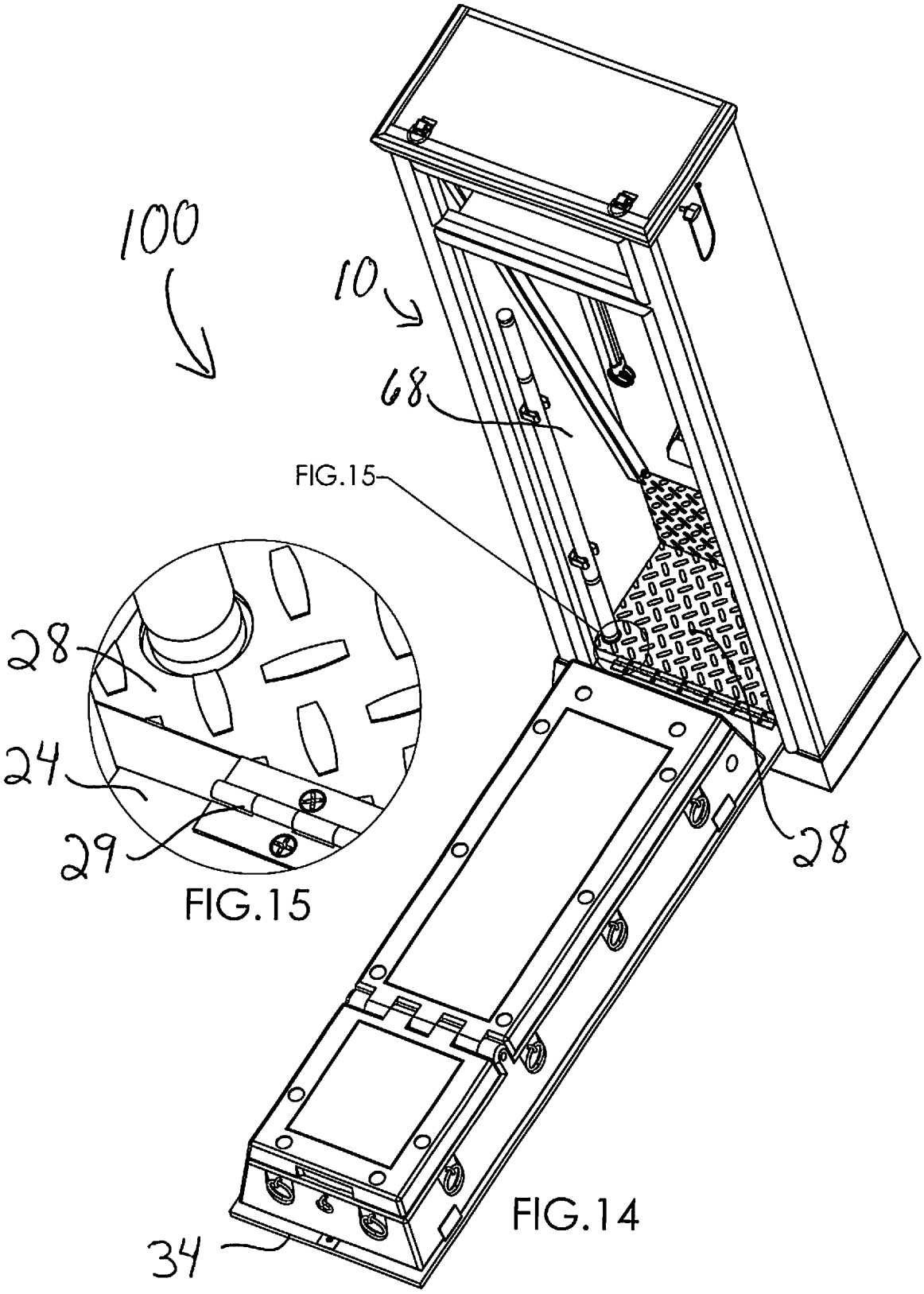
FIG. 14 is top, right-side perspective view of the front of the subject combined machine and cabinet 100 of FIG. 8, in the open, or deployed for use, position.
FIG. 15 is detail of a region circled in FIG. 14, showing a region of the cabinet floor and a portion of the door hinge.

FIG. 14 is another top, right-side perspective view of the front of the subject combined machine and cabinet 100 of FIG. 8, in the open, or deployed for use, position.

FIG. 15 is detail of a region circled in FIG. 14, showing a region of the cabinet floor 28 and a portion of the door hinge 29.

Figures 16, 17:
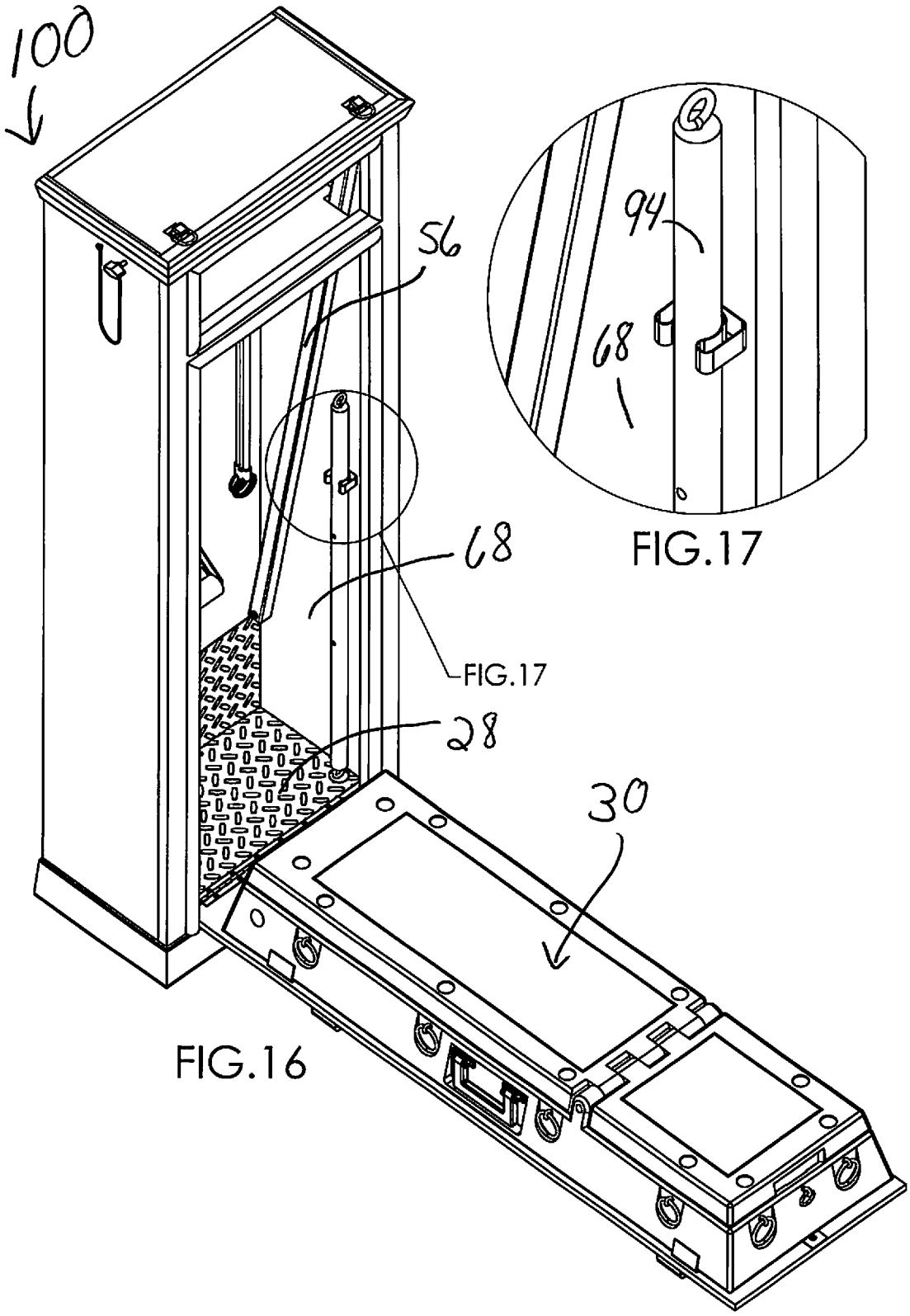
FIG. 16 is a top, left-side perspective view of the front of the subject combined machine and cabinet of FIG. 8, in the open, or deployed for use, position.
FIG. 17 is a detail of the region circled in FIG. 16, showing one of the clips installed inside the cabinet interior space, holding another exercise accessory/element.

FIG. 16 is a top, left-side perspective view of the front of the subject combined machine and cabinet 100 of FIG. 8, in the open, or deployed for use, position.

FIG. 17 is a detail of the region circled in FIG. 16, showing one of the clips 90 installed inside the cabinet interior space IS, holding an exercise member, such as an extension bar 94, in storage until needed by a user in an exercise.

Figures 18, 19:
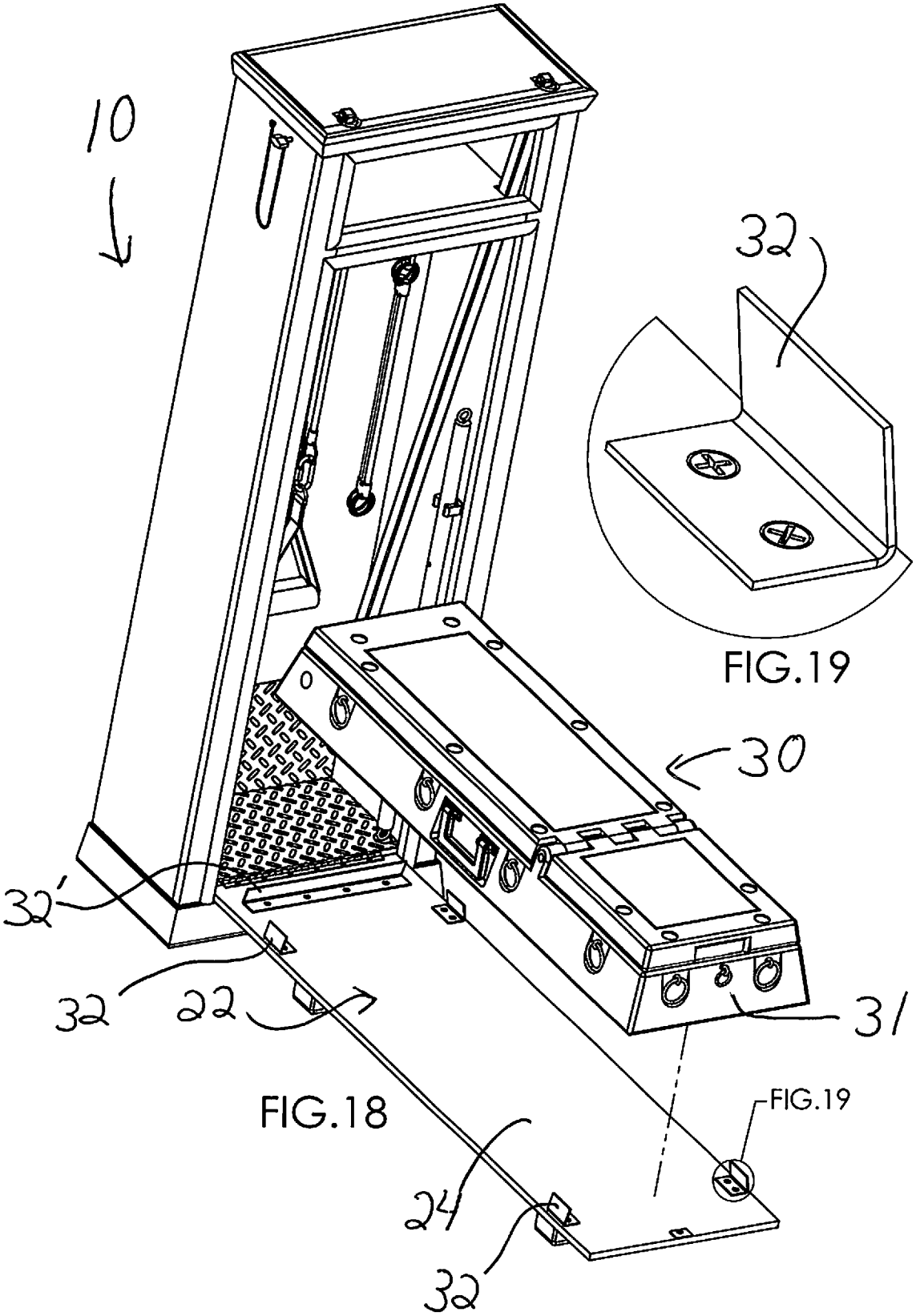
FIG. 18 is a partially-exploded view of FIG. 16, showing the fitness machine separated from, and lifted up above, the door/deck of the cabinet.
FIG. 19 is a detail of the region circled in FIG. 18, showing a retainer/stop that retains the fitness machine from sliding to the right off the door of the cabinet.

FIG. 18 is a partially-exploded view of FIG. 16, showing the fitness machine 30 lifted up from the door/deck 22 of the cabinet 10. This view reveals multiple retainers/stops 32 that retain/stabilize the fitness machine 30 on the inside door/deck top surface 24. Four side retainers/stops 32 are shown, two near the right edge (see the detail view in FIG. 19, of the circled region of FIG. 18), and two near the left of the top surface 24. A longer, inner-edge retainer/stop 32' is shown near the hinge 29. Note that these retainers/stops will tend to keep the fitness machine from sliding to the right or left, or rearward toward the cabinet 10. This way, normal exercise forces will not dislodge the fitness machine 30 from the door/deck 22, but the fitness machine 30 may be purposely slid forward off of the door/deck when desired. If exercise forces are expected to be applied to the fitness machine in a direction that would slide the machine forward off the door/deck, an additional, typically releasable, retainer/stop or other latch (not shown) may be provided at the outer-edge 34 of the door to grasp/retain the outer edge of the machine. Alternatively, a fitness machine 30 or other exercise apparatus may be permanently installed on, or built integrally with, the door/deck 30, in or generally in the position shown in FIGS. 8 and 16, for example.

Figure 29:
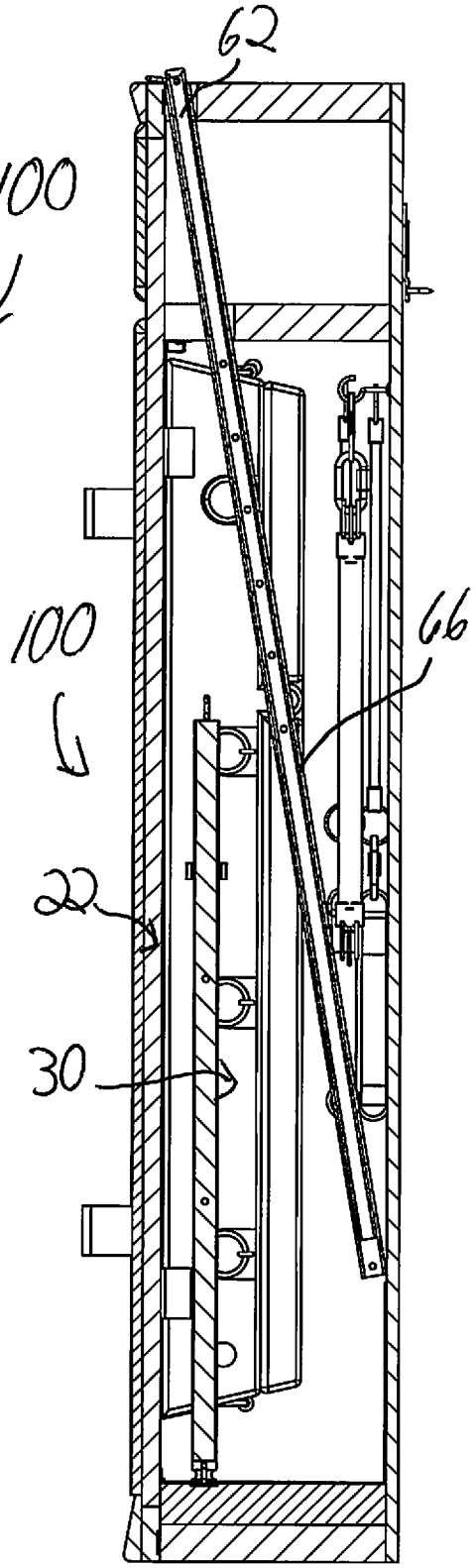
FIG. 29 is a cross-sectional view along the line 29-29 in FIG. 28, showing to best advantage the sleeve and rod assembly, wherein in this view the rod is retracted into the sleeve for storage.
Figure 29A:
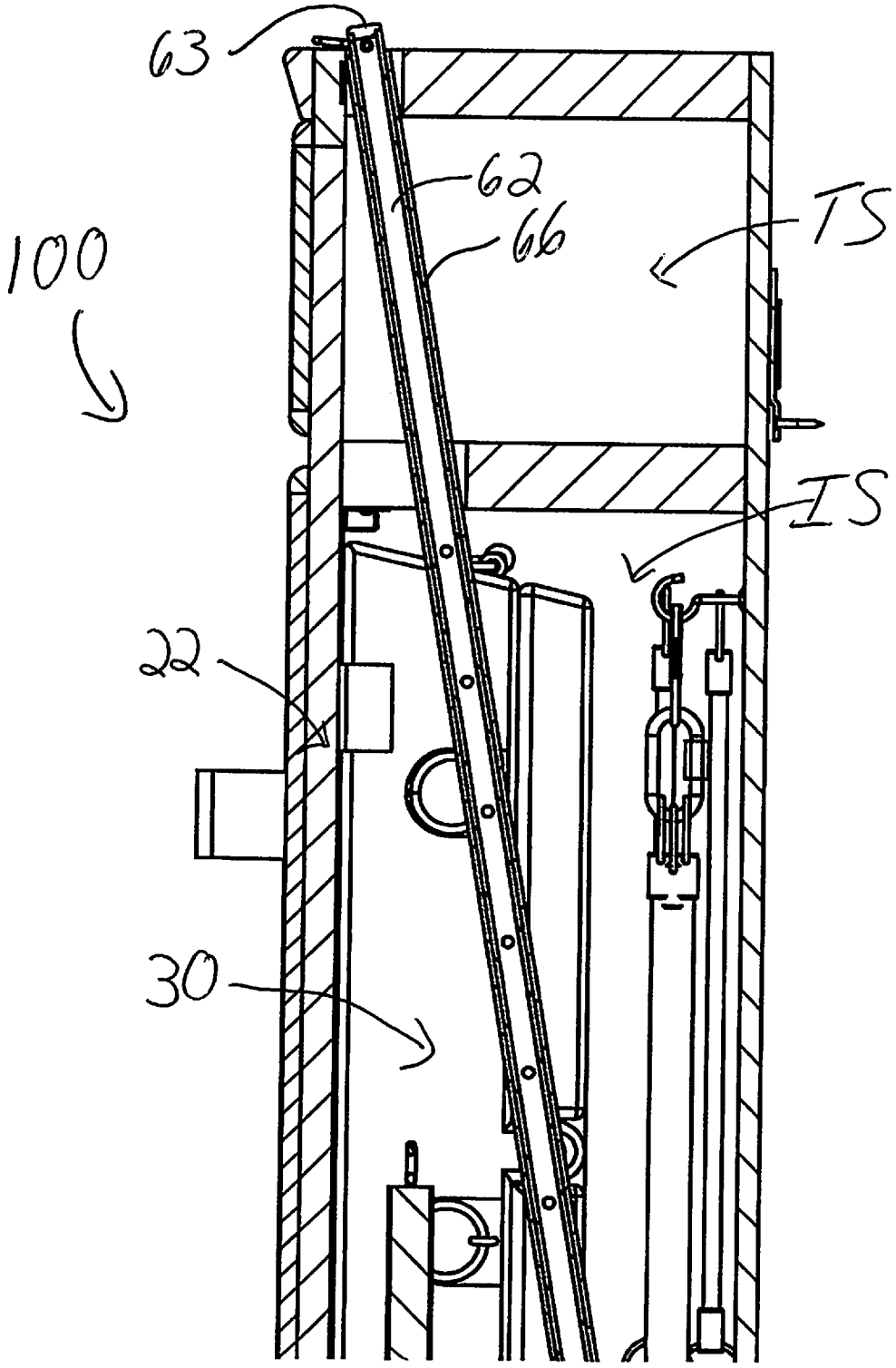
FIG. 29A is an enlarged detail of the cross-sectional view of FIG. 29, showing to best advantage the overhead rod inside the sleeve 66 that is provided at a slanted orientation on the side wall inside the cabinet.

FIG. 20 is a view similar to that in FIG. 8, except in FIG. 20 two rigid overhead rods 52, 62 or other arms extend outwardly from the top 36 of the cabinet 10 and are connected to cords/cables (here, stretch straps with handles 82) for use in overhead exercises. One may note that the latch chain 12 of FIG. 2 is employed to hold the overhead rod 52 in place in this extended position, as a result of the latch pin being inserted through a selected one of several through-holes that extend transversely through the rod 52. One may see another through-hole that extends through the rod a short distance above where the latch pin is inserted, illustrating that the overhead rod 52 may be extended/lifted to various incremental, selectable heights, as desired by the user and sometimes dictated by the user's height, and then fixed in that selected incremental height by insertion of the latch pin through the selected through-hole. Likewise, in FIG. 20 the left overhead rod 62 has also been lifted and latched by the left latch pin of the left latch chain 14, to match the extension and height of the right overhead rod 52. The straps with handles 82 are hanging down, but it will understood by those of skill in this field that they will be used in exercises that are possible because of the elevated location of the uppermost ends 53, 63 of the overhead rods 52, 62. Note that the overhead rods extend up from the top wall and top surface 36 of the cabinet 10. The overhead rods also preferably extend at a non-vertical and non-horizontal angle, for example, in the range of 10-30 degrees, but more preferably in the range of 15-25 degrees, and most preferably in the range of 20-25 degrees, to vertical, forward toward the front of the cabinet 10. The outermost (uppermost) ends of the overhead rods will typically extend, for example, to the plane of the front wall 38 of the cabinet 10, or slightly forward (1-2 inches), or a several inches (2-4 inches, or 2-6 inches) forward of the plane of the front wall 38 of the cabinet 10, depending on how far up above the top surface 36 the overhead rods are extended when latched and used. Additional details of the preferred overhead rod system are shown in FIGS. 29 and 29A. Note that the foldable portions of the fitness machine are folded and flattened in these views.

FIG. 21 is a detail of a circled region of FIG. 20.

Figures 22, 23:
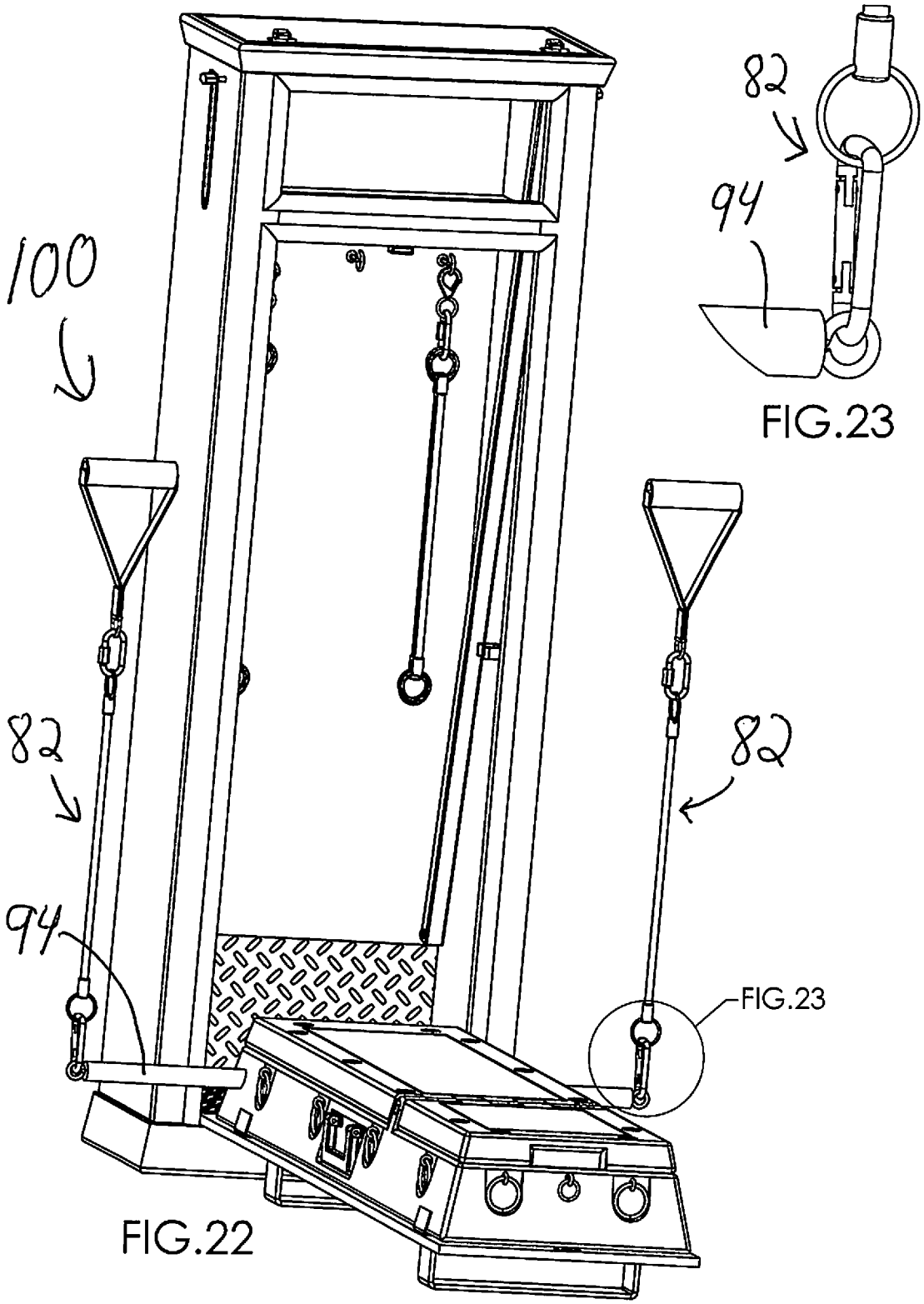
FIG. 22 is a view similar to the view depicted in FIG. 16, except that an extension bar (stored in FIG. 17) is inserted horizontally transversely through holes in the side of the box-like main body of the fitness machine, and a stretch strap and handle are connected to each end of the bar, for additional exercises.
FIG. 23 is a detail view of the region circled in FIG. 22, showing one possible connection to the extension bar.

FIG. 22 is a view similar to the view depicted in FIG. 16, except that an extension bar 94 (stored in FIG. 17) is inserted horizontally transversely through holes in the side of the box-like main body 31 of the fitness machine, and a stretch strap and handle are connected to each end of the bar, for additional exercises.

FIG. 23 is a detail view of the region circled in FIG. 22, showing one possible connection to the extension bar.

Figure 24:
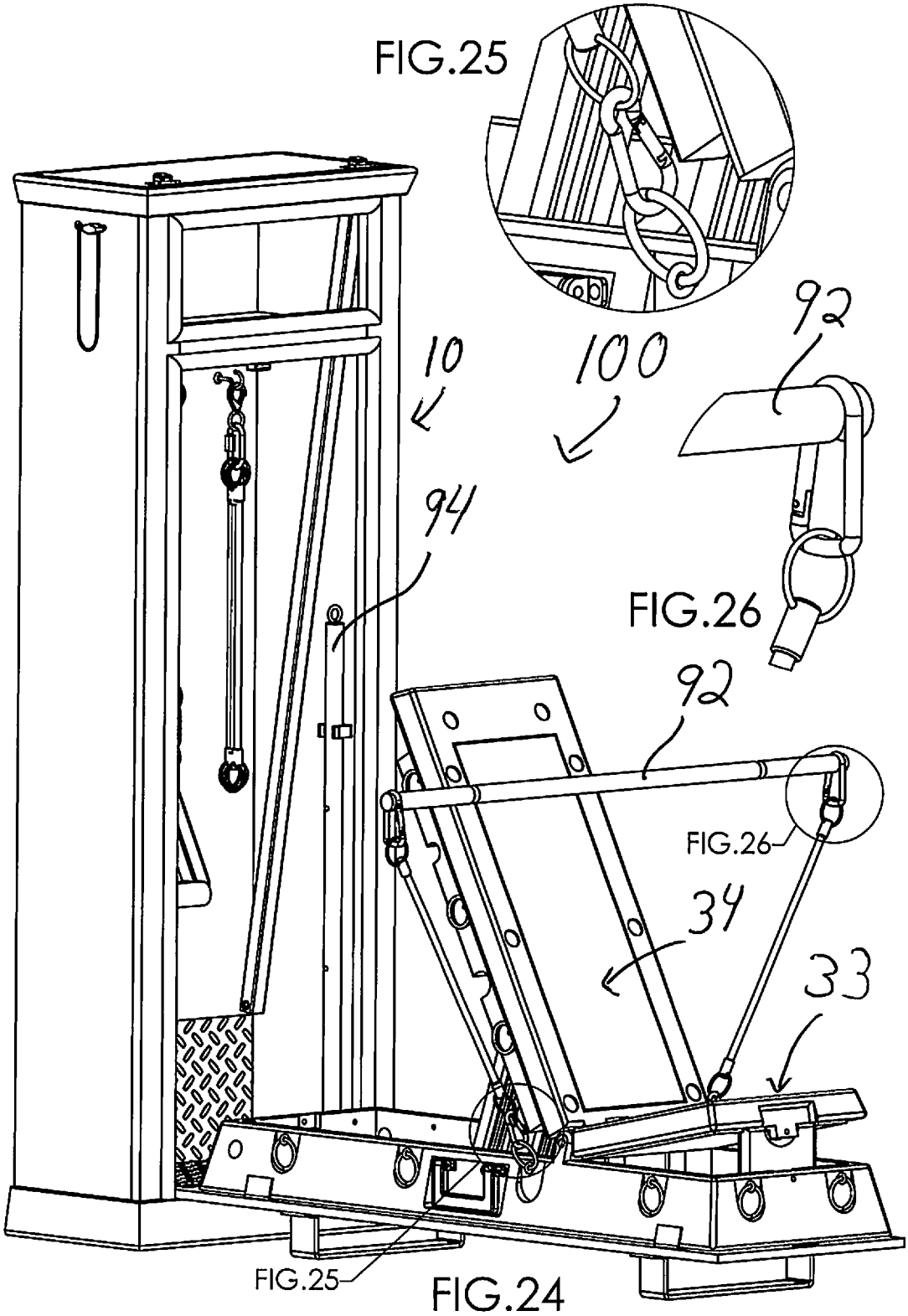
FIG. 24 is a view similar to the view depicted in FIG. 16, except in FIG. 24 the top surface portions of the box-like main body of the fitness machines are depicted as having been opened upwardly and secured at different angles to provide a seat and a seat back, for exercises using a combar that is shown in a position such as a user would hold it for exercising.

FIG. 24 is a view similar to the view depicted in FIG. 16, except in FIG. 24 the top surface portions of the box-like main body 31 are depicted as having been opened upwardly and secured at different angles to provide a seat and a seat back, for exercises using the combar. As illustrated by FIGS. 24-26, the ends of the combar 92 may be connected to cables/cords/stretch-straps (FIG. 26), which are connected to rings or other fasteners on the main body 31 (FIG. 25). Note, in FIG. 24, that the fitness machine 30 is effectively raised above the floor by resting on the door/deck 22, which in turn is raised above the floor, in this case, by virtue of being hinged 29 at is lower edge to the bottom floor 28 of the cabinet that may be raised a few inches above the floor F, for example, and comprising footings or handles 23 at one or more locations along it length that rest directly on the floor F.

Figure 27:
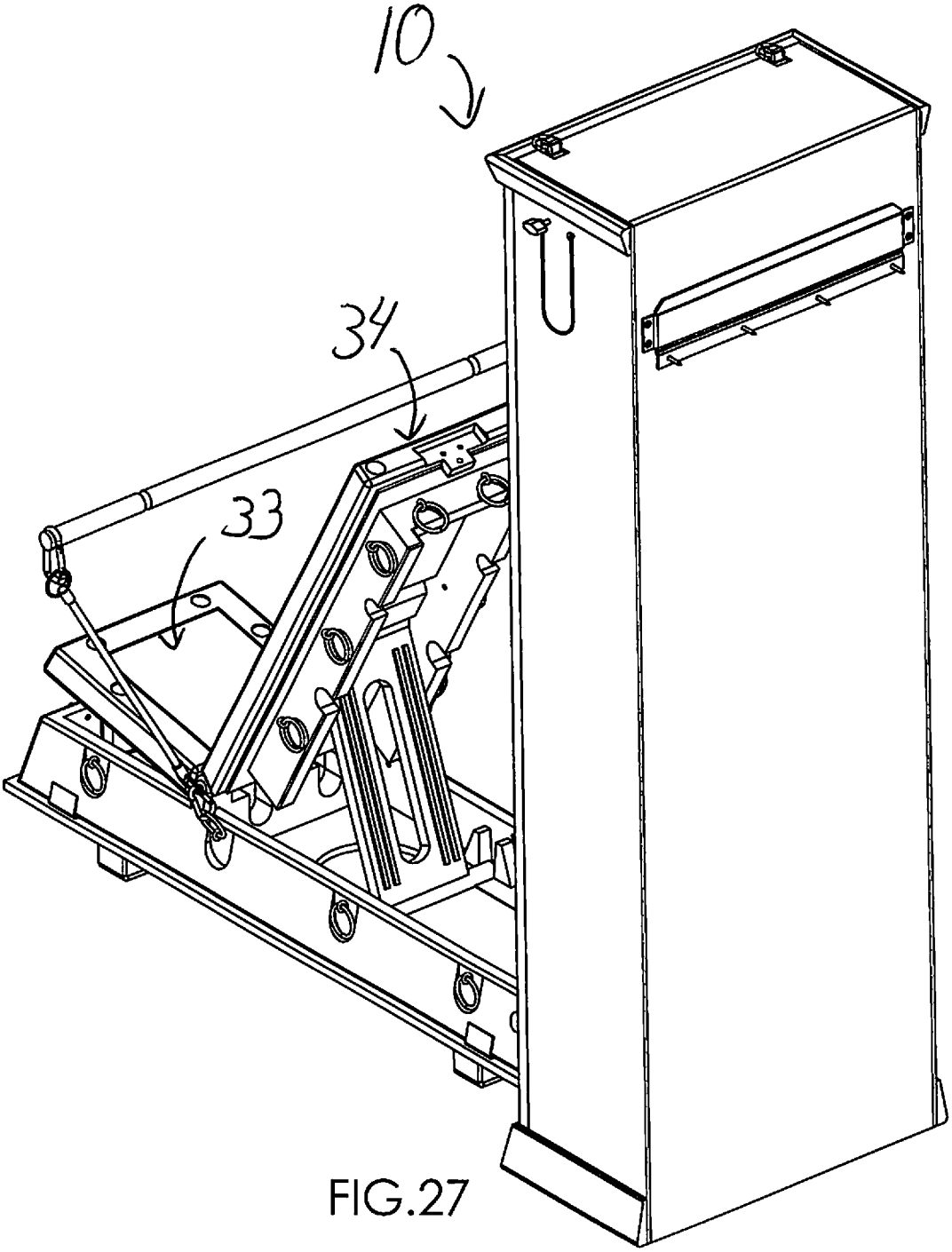
FIG. 27 is a top, right-side perspective view of the back of the subject combined machine and cabinet 100, open and arranged for use as in FIG. 24.

FIG. 27 is a top, right-side perspective view of the back of the subject combined machine and cabinet 100, open and arranged for use as in FIG. 24. In this view, one may see more details of the portrayed exemplary fitness machine, and the combar 92 strapped to a ring fastened to the main body 31 for use by a forward-facing user.

Figure 28:
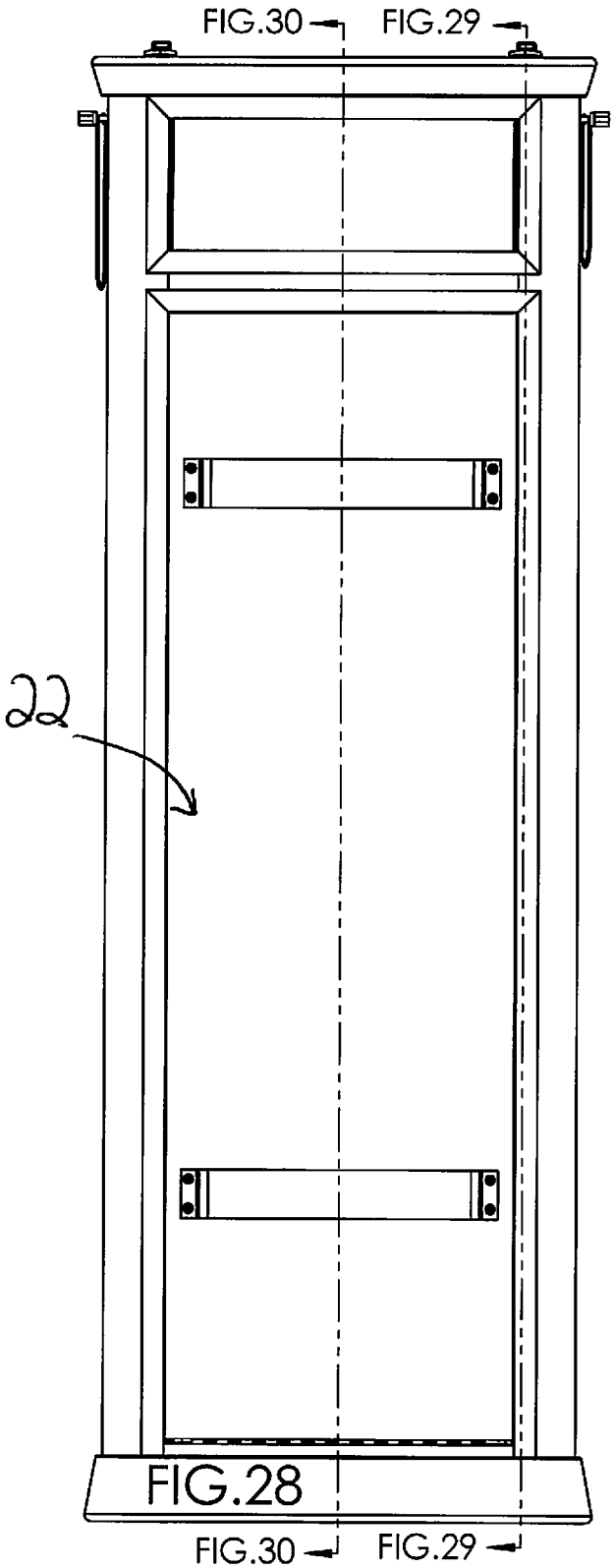
FIG. 28 is a back view of the subject combined machine and cabinet 100 depicted in FIG. 27, with the door and fitness machine lifted to the storage position, and with the door closed.

FIG. 28 is a back view of the subject combined machine and cabinet 100 depicted in FIG. 27, with the door 22 and fitness machine 30 lifted to the storage position, and with the door 22 closed. Even in embodiments wherein the fitness machine 30 is slidably removable from the door, the machine 30 and/or retainers 32, 32' are adapted so that pivoting the door closed, with the machine 30 on it, does not allow the machine to slide or fall off/away from the door.

FIG. 29 is a cross-sectional view along the line 29-29 in FIG. 28. This view shows to best advantage details of the telescoping overhead rod system, with the rod 62 retracted/lowered into a sleeve 66 secured to the inside side-wall 68 of the cabinet 10. One can see the rod 62 inside the sleeve 66 in this view, and one can see the multiple through-holes 65 provided in the rod 62 for receiving the latch pin 15 to hold the rod 62 at the selected height extension above the cabinet 10. On can see that the sleeve extends from at or near the top wall of the cabinet, through the top space TS, and through the interior space IS most of the way to the bottom floor 28, thereby extending through/along 60-90 percent, or more preferably 70-85 percent, of the length (height from top to bottom) of the cabinet and/o or of the combined top and interior spaces TS and IS The D-ring at the top of the rod 62 extends along/over the top surface 36 of the cabinet 10 and limits how far the rod 62 may lower/fall into the sleeve 66. Alternatively, other limits or latches could be used to control the rod from lowering/falling further than desired into the cabinet 10, but the preferred D-ring, or other conventional limits or latches, are preferably designed to be accessible from the outside of the cabinet 10. For example, the user may grasp the D-ring and use it as a handle to lift the overhead rod to the desired height, and the user need not try to manipulate the rod from the inside of the cabinet 10. Likewise, when done with the overhead exercise, the user may remove the latch pin, and lower the rod by using the D-ring as a handle, until the D-ring rests again on the top surface 36 of the cabinet 10 (see FIG. 32).

FIG. 29A is an enlarged detail of the cross-sectional view of FIG. 29, showing the overhead rod 62 inside the sleeve 66 that is provided at a slanted orientation on the side wall 68 inside the cabinet 10. The sleeve 66 is preferably strong and rigid, and fixed to the sidewall 68 very securely, so that it receives the rod 62 without bending, and holds the rod 62 in place securely and immovably during use of the rod 62, which is important as said use can involve large forces pulling on the outer end 63 of the rod 62, and, hence large forces on the sleeve 66.

From FIGS. 29 and 29A, one may see that the certain embodiments of the sleeve 66, and its right-hand sleeve 56 counterpart that holds rod 52, are fixed to the cabinet at an angle to vertical in the range of 10-30 degrees, but more preferably in the range of 15-25 degrees, and most preferably in the range of 20-25 degrees to vertical, which sets the angle of the rods 52, 63 at the same angle as the sleeves. The rods 52, 63 are portrayed as square rods in square sleeves, which helps prevent rotation of the rods in the sleeves, but other combinations of shapes of rods and sleeves may be used in certain embodiments.

Figure 30:
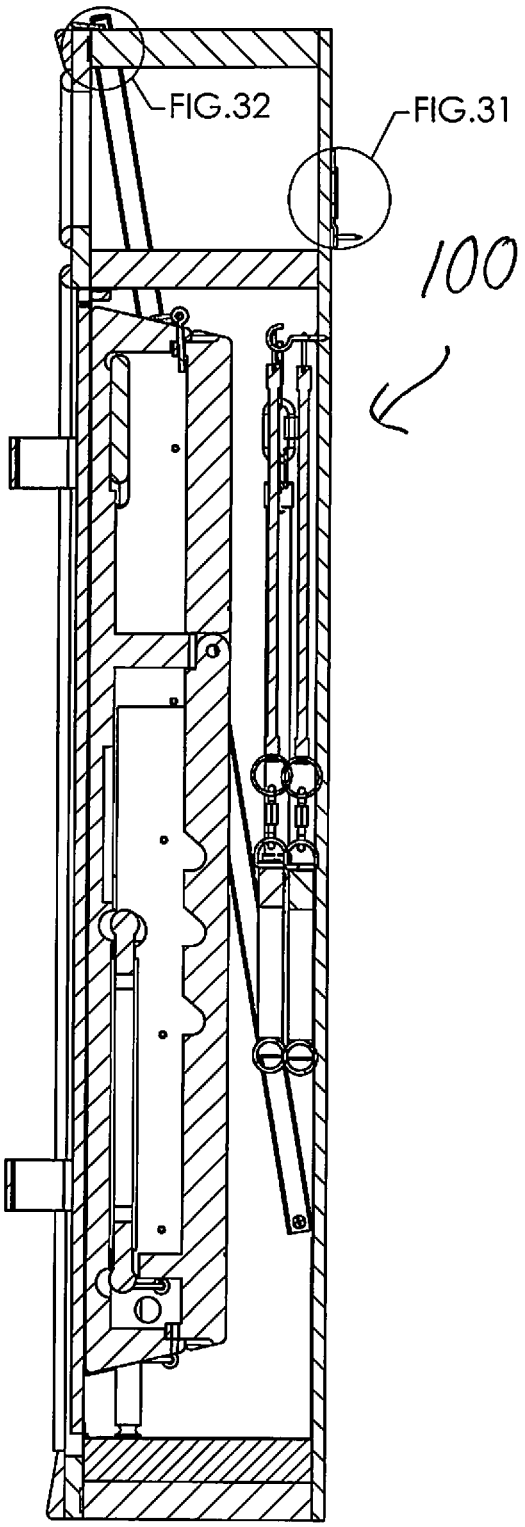
FIG. 30 is a cross-sectional view of FIG. 28, viewed along the line 30-30 in FIG. 28.

FIG. 30 is a cross-sectional view of FIG. 28, viewed along the line 30-30 in FIG. 28.

Figure 31:
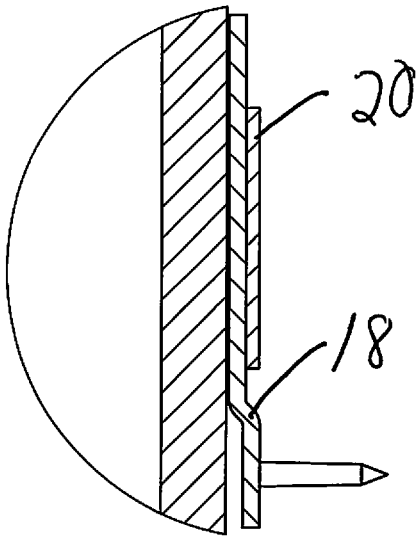
FIG. 31 shows a detail circled in FIG. 30, which is an end view of the securement system for connection to the wall.
Figure 32:
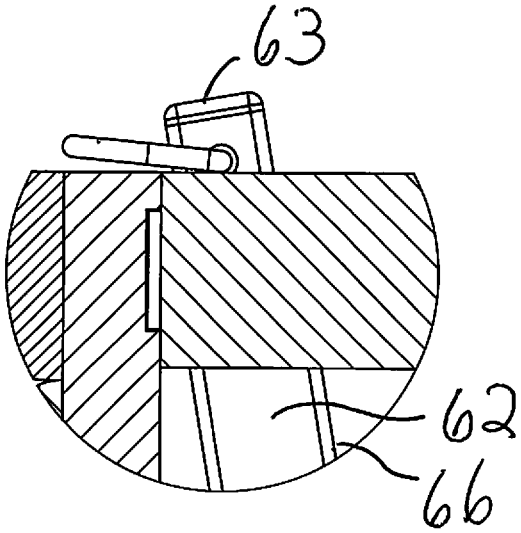
FIG. 32 shows a second detail circled in FIG. 30, which is a D-ring handle system for raising and lowering the overhead rod.

FIG. 31 and FIG. 32 show details circled in FIG. 30, of the securement system for connection to the wall, and the D-ring handle system for use of the overhead rod, respectively.

FIG. 33 shows the trim exploded away from the closed cabinet 10, to show a steel reinforcing L-bracket 37 that helps secure the two overhead rods under heavy stress that may occur during overhead exercises.

Figure 34:
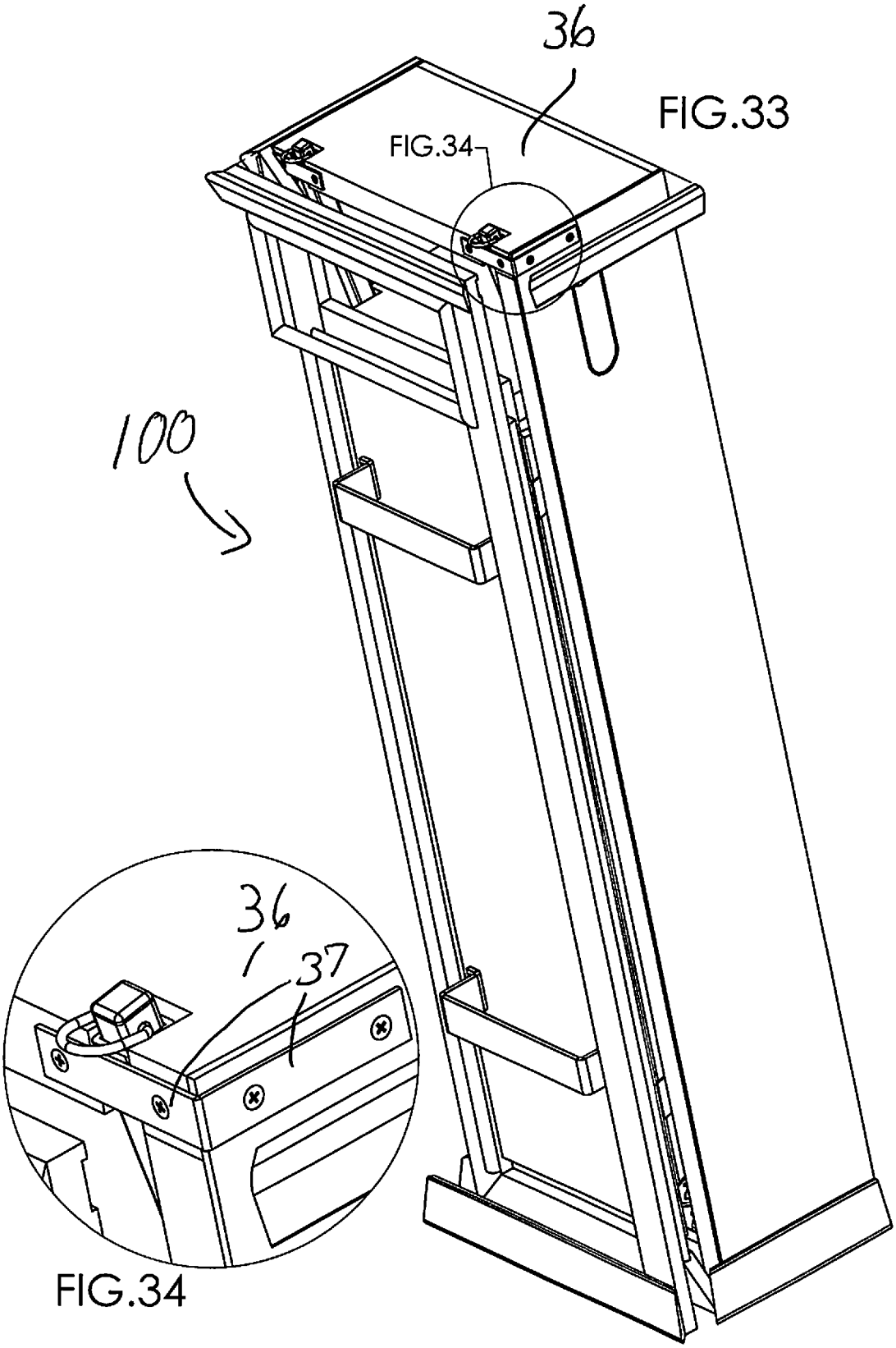
FIG. 34 is an enlarged detail of the circled region of FIG. 33.

FIG. 34 is a detail of the circled region of FIG. 33.

Figure 35:
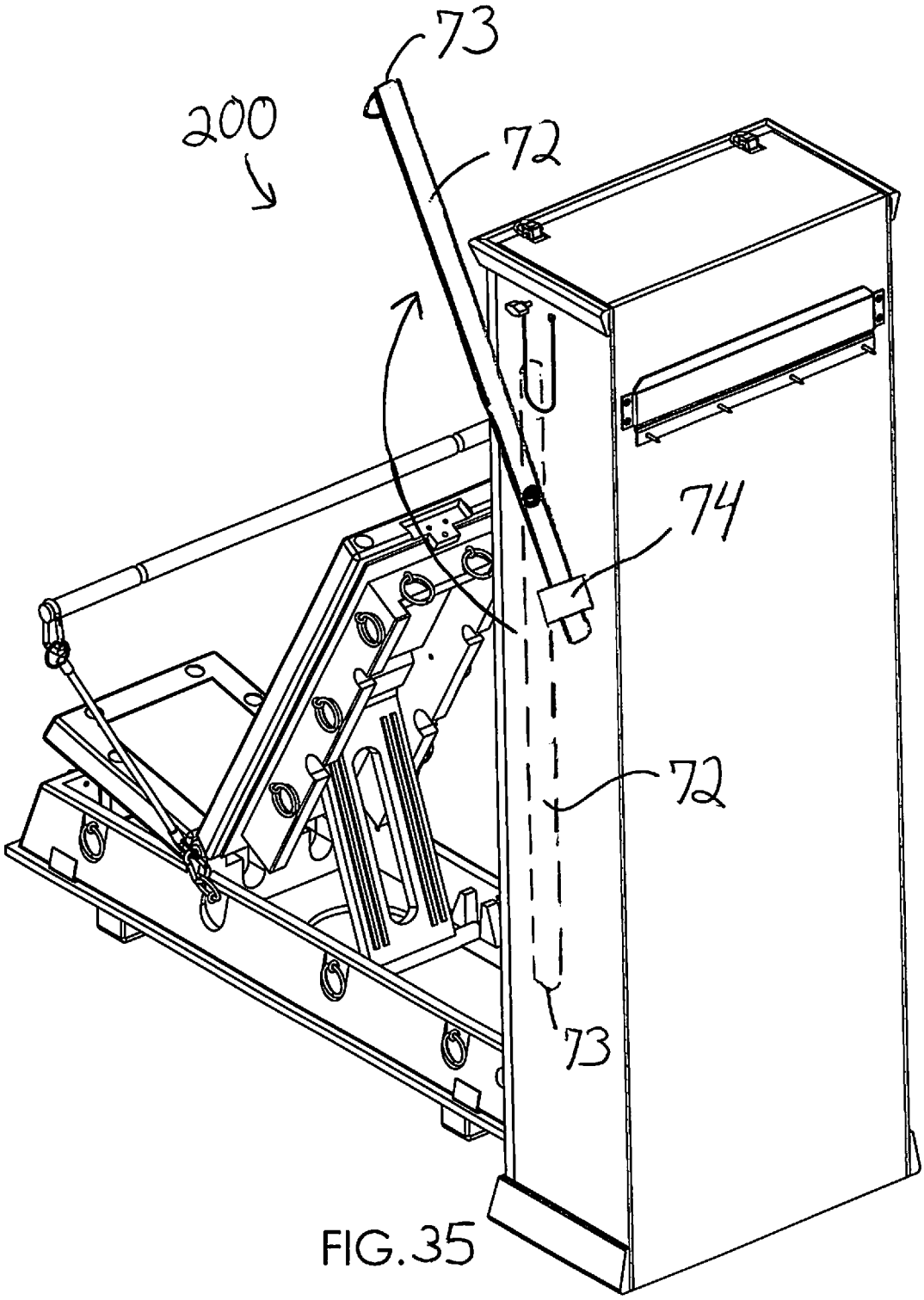
FIG. 35 is a schematic rear perspective view showing an overhead-exercise rod embodiment that pivots upward to place its outer end above and forward of the cabinet for overhead-exercise.

FIG. 35 is a schematic rear perspective view of an alternative embodiment 200 showing an overhead-exercise rod embodiment that pivots upward to place its outer end 73 above and forward of the cabinet for overhead-exercise. The rod 72 is pivotally connected to a side wall of the cabinet and can swing from a retracted position (dashed lines) extending down along the side wall, to an in-use position where it is temporarily secured in place for use, for example, by various clamps, pins, stops and/or other fasteners schematically represented by 74 in FIG. 34. Such a rod 72 may be used instead of rods 52, 62 in certain embodiments, or in addition to rods 52, 62 in certain embodiments.

The cabinet 10 and the combination of machine and cabinet 100 may be made of conventional materials, with conventional carpentry and/or manufacturing methods, with strength of the materials and of construction being a significant consideration due to the exercise forces that are typically placed thereof.

Although this disclosed technology has been described above, and portrayed in the Figures, with reference to particular means, materials, and embodiments, it is to be understood that the disclosed technology is not limited to these disclosed particulars, but extends instead to all equivalents within the broad scope of the following claims.

The invention claimed is:

1. A combined fitness machine and cabinet comprising:

a plurality of walls, each wall having an inside and outside surface, the inside surfaces of the walls defining an interior volume of the cabinet;

wherein said plurality of walls comprises a movable wall receiving and securing a fitness machine on the movable wall's inside surface, and the movable wall adapted to move from an upright closed-cabinet position wherein the fitness machine is contained inside the interior volume of the cabinet, to a horizontal or generally horizontal opened-cabinet position wherein the movable wall is at least partially in contact with a floor and wherein the fitness machine is placed horizontally or generally horizontally;

wherein the plurality of walls comprises a top wall and wherein the movable wall is a front wall, and the cabinet comprises a rod extending out from the cabinet above the top wall and forward of the front wall, wherein the rod holds an exercise accessory for a user to do overhead exercises.

2. The combined fitness machine and cabinet of claim 1, wherein the fitness machine is slidable off of the moveable wall in a direction away forward away from the cabinet interior volume.

3. The combined fitness machine and cabinet of claim 1, wherein the rod extends out from the cabinet, and the exercise accessory is used by the user on the fitness machine, while the fitness machine is deployed, thereby imparting to the fitness machine increased functionality.

4. The combined fitness machine and cabinet of claim 1 wherein said movable wall of the cabinet releaseably receives and secures the fitness machine.

5. The combined fitness machine and cabinet of claim 1 wherein:

the movable wall is moveable by rotating about a hinge at a bottom edge of the movable wall.

6. The combined fitness machine and cabinet of claim 1 wherein:

the cabinet has a plurality of said rods extending out from the cabinet.

7. The combined fitness machine and cabinet of claim 1 wherein:

the rod extends out from the cabinet by telescoping within a surrounding sleeve.

8. The combined fitness machine and cabinet of claim 1 wherein:

the rod extends out from the cabinet by sliding up and forward from a sleeve fixed to the inside surface of one of the plurality of walls of the cabinet, and wherein the sleeve is fixed to said inside surface at an angle in the range of in the range of 10-30 degrees from vertical.

9. The combined fitness machine and cabinet of claim 1 wherein:

the rod extends out from the cabinet by rotation about a pivotal connection on the cabinet.

* * * * *